United States Patent [19]

Reed

[11] Patent Number: 4,850,902

[45] Date of Patent: Jul. 25, 1989

[54] ELECTRICAL CONNECTOR HAVING IMPROVED CHARACTERISTICS FOR RETAINING LEADS TO THE CONNECTOR HOUSING AND METHOD OF MAKING THE ELECTRICAL CONNECTOR

[75] Inventor: Carl G. Reed, Clemmons, N.C.

[73] Assignee: AMP Incorporated, Harrisburg, Pa.

[21] Appl. No.: 179,604

[22] Filed: Apr. 11, 1988

[51] Int. Cl.[4] ..... H01R 13/432

[52] U.S. Cl. ..... 439/676; 439/741

[58] Field of Search ..... 439/62, 76, 676, 733, 439/741, 743

[56] References Cited

U.S. PATENT DOCUMENTS

| | | | |
|---|---|---|---|
| 3,754,203 | 8/1973 | Pauza et al. | 439/733 |
| 3,862,792 | 1/1975 | Jayne | 439/733 |
| 4,210,376 | 7/1980 | Hughes et al. | 439/676 |
| 4,491,376 | 1/1985 | Gladd et al. . | |
| 4,533,203 | 8/1985 | Feldman et al. . | |
| 4,697,864 | 10/1987 | Hayes et al. . | |

FOREIGN PATENT DOCUMENTS 0147039 3/1985 European Pat. Off. .

*Primary Examiner*—Joseph H. McGlynn
*Attorney, Agent, or Firm*—Eric J. Groen

[57] ABSTRACT

An electrical connector intended for mounting on a printed circuit board has an insulating body and leads extending from the body. Each lead has an integral spring portion and an end portion. The insulating body has an aligning or locating stop and the lead adjacent to its end is biased against the locating stop by the integral spring. The locating stop thus ensures that the extreme ends of the leads will be in aligned coplanar relationship. The terminals are also formed with an integral spring which spring biases the lead portions against the stop means and spring biases a retention barb further into retentive condition.

13 Claims, 6 Drawing Sheets

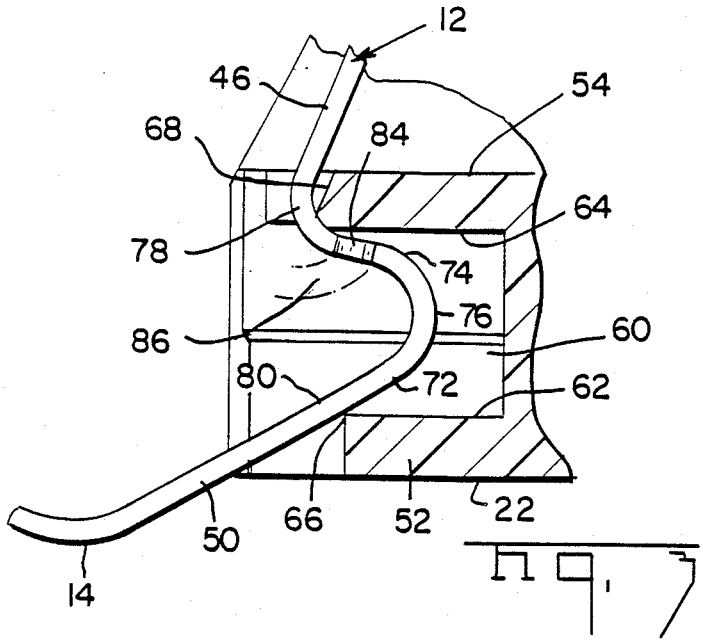
FIG. 7
FIG. 4
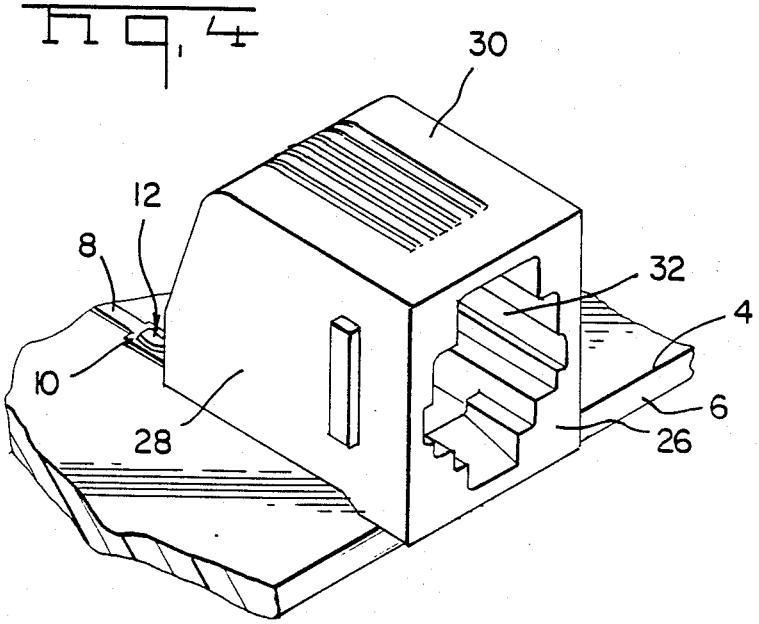

ELECTRICAL CONNECTOR HAVING IMPROVED CHARACTERISTICS FOR RETAINING LEADS TO THE CONNECTOR HOUSING AND METHOD OF MAKING THE ELECTRICAL CONNECTOR

FIELD OF THE INVENTION

This invention relates to electrical connectors which are intended for mounting on printed circuit boards and more particularly to improvement to the retention of the leads to the connector body.

BACKGROUND OF THE INVENTION

It is typical for electrical connectors which are mounted on printed circuit boards to include electrical terminals, where the lead portion of the terminal extends horizontally over the housing, or through the housing to a position where the terminal is bent over a mandel which is integral with the housing. This bending forms a vertical portion of the terminal extending towards the suface of the printed circuit board. This could be of either type, through hole mount or surface mount. The housing and the terminals require some cooperation in order for the terminals to be retained to the housing. This retention is required for precise alignment with traces on the printed circuit board; with the through holes in the case of such mounting, or with terminal pads on the upper surface of the printed circuit in the event of surface mount connectors. Much devotion has been given to such retention features as evidenced by U.S. Pat. No. 4,697,864.

One such method for retaining terminals to the housing is to include barbs on the terminals, and channels integral with the housing for receipt of the barbs in the channels in an interfering fit. Such a connector is shown in U.S. Pat. No. 4,210,376 as having a plurality of electrical terminal portions for interconnection to printed circuit board through holes. The terminal portions of the connector are arranged in two spaced apart rows along the back side of the housing to position the lead ends into two staggered rows of terminals. This connector is also available in a surface mount version where the lead ends are bent upwardly for contact on the surface of the printed circuit board rather than through a hole in the printed circuit board.

One problem which exists with such barbs is that a force on the lead portion of the terminals results in the barbs, and the associated leads, backing out of the channel through the same path which it formed during entry. This drawback is more predominant in the event of a surface mount connector where a reaction force is exerted on the surface mount contact due to the resilience of the contact when the connector is placed on the printed circuit board, yet prior to the soldering of the contact portion to the terminal pad. This biasing force can cause the lead portions to pop out of the channels while attempting to position the connector on the printed circuit boards, which causes undue difficulty in managing and positioning the lead ends relative to the pads on the printed circuit boards.

The present invention is directed to the achievement of a retention feature for printed circuit board mounted connectors which satisfy the requirements discussed above.

THE INVENTION

It is an object of the invention to design a connector having improved retention of the lead ends of the terminals to the housing.

To comply with the object of the invention, the terminals include retention means for retaining the terminals against the housing where the retention means is provided by the inclusion of integral spring portions with the terminal means, and the terminals further including retention portions which cooperate with the insulative housing, the spring portions biasing the retention portions into further retentive condition.

The retention means are provided by providing at least one channel on one face of the connector and by providing at least one retention barb on a portion of the lead means. The lead means is bent over a first mandrel to dispose the lead means in a position adjacent to the channel. Finally, the portion of the lead means carrying the barb is moved into the channel where the barbs interferingly retain the lead means to the housing.

THE DRAWING FIGURES

FIG. 3 is an enlarged fragmentary view showing details of a mounting lead and illustrating the manner in which the leads are maintained in coplanar relationship.

FIG. 4 is a perspective view showing the connector mounted on the circuit board.

FIG. 5A is an enlarged view of the retention barb which is located on the terminal.

FIG. 8 is a view similar to FIG. 3 but showing an alternative embodiment.

THE DISCLOSED EMBODIMENT

Figure 1:
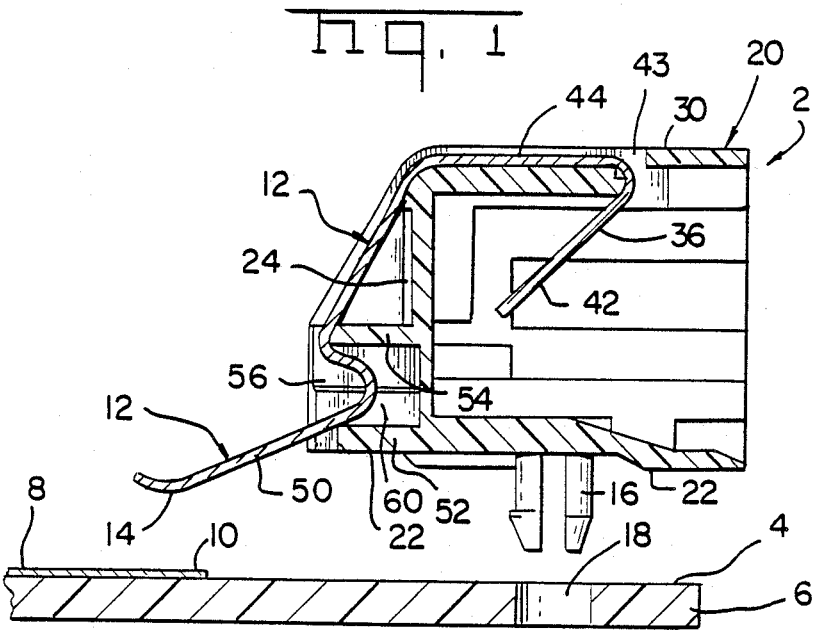
FIG. 1 is a cross sectional view of a connector which is spaced from the mounting surface of a circuit board.

FIG. 1 shows an electrical connector 2 which is positioned above the mounting surtace 4 of a circuit board 6 in preparation for mounting of the connector on the circuit board. The connector shown is of the general type described fully in U.S. Pat. No. 4,210,376 which is hereby incorporated by reference in its entirety. The connector shown in the drawing is specially adapted for surface mount applications to printed circuit boards; however, the following discussion will indicate that the invention is suitable for use with surface mount or through hole leads. The general features of the connector will be described only briefly and to the extent necessary for an understanding of the present invention. Those features of the conductors and leads which pertain to the instant invention will be described in detail.

Figure 2:
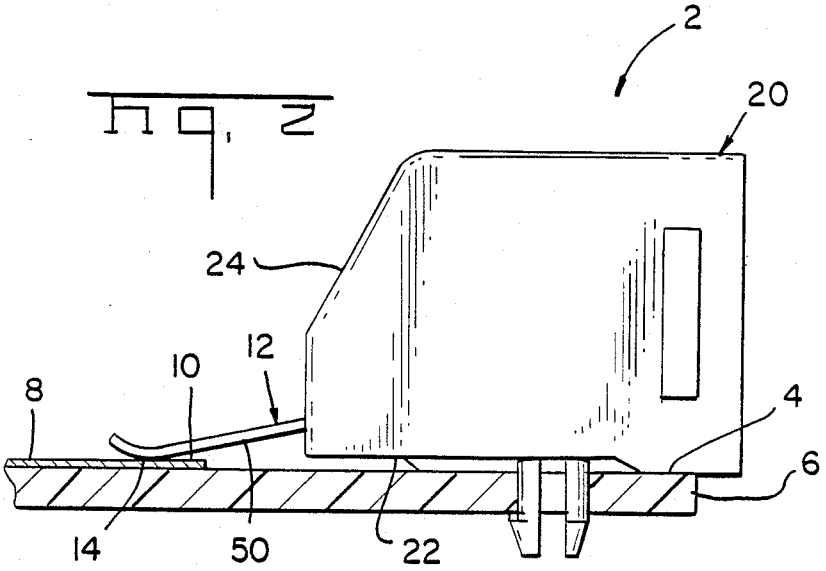
FIG. 2 is a side view showing the connector mounted on the circuit board.

The mounting surface 4 of the circuit board 6 has circuit board conductors 8 thereon which extend to terminal pads 10. The housing 20 of the connector has integral mounting posts 16 which are received in holes 18 in the circuit board. The ends 50 of the leads which extend from the connector housing have contact portions 14 which are inteded to be connected by soldering to the terminal pads 10. The connector is assembled to the circuit board by moving it downwardly from the position shown in FIG. 1 to the position shown in FIGS. 2 and 4 so that the mounting posts 16 enter the holes 18 and the contact portions 14 of the lead 50 are located against the terminal pads 10. The terminal pads 10 are coated with a viscous solder composition which can be reflowed to establish a bond between the contact portions 14 and the terminal pads 10.

Successful execution of surface mounting processes requires that the contact portions 14 be against the terminal pads 10 when the soldering process is carried out and preferably these contact portions should be resiliently biased against the terminal pads with a force sufficient to ensure good electrical contact when the solder is reflowed. The structural features of the leads and the connector housing which achieve these objects are described in detail below.

As shown in FIG. 1, the connector 2 comprises an insulating housing 20 having a downwardly facing, as viewed in the drawing, mounting surface 22, a rear side surface 24 which extends transversely of the mounting surface, a mating face 26, (FIG. 4) oppositely facing external end walls 28, (FIG. 4) and an external top wall 30. A plug receiving opening 32 extends inwardly from the mating face 26 and is dimensioned to receive a standard modular plug of the type used in telephone and other electronic circuits.

Figure 5:
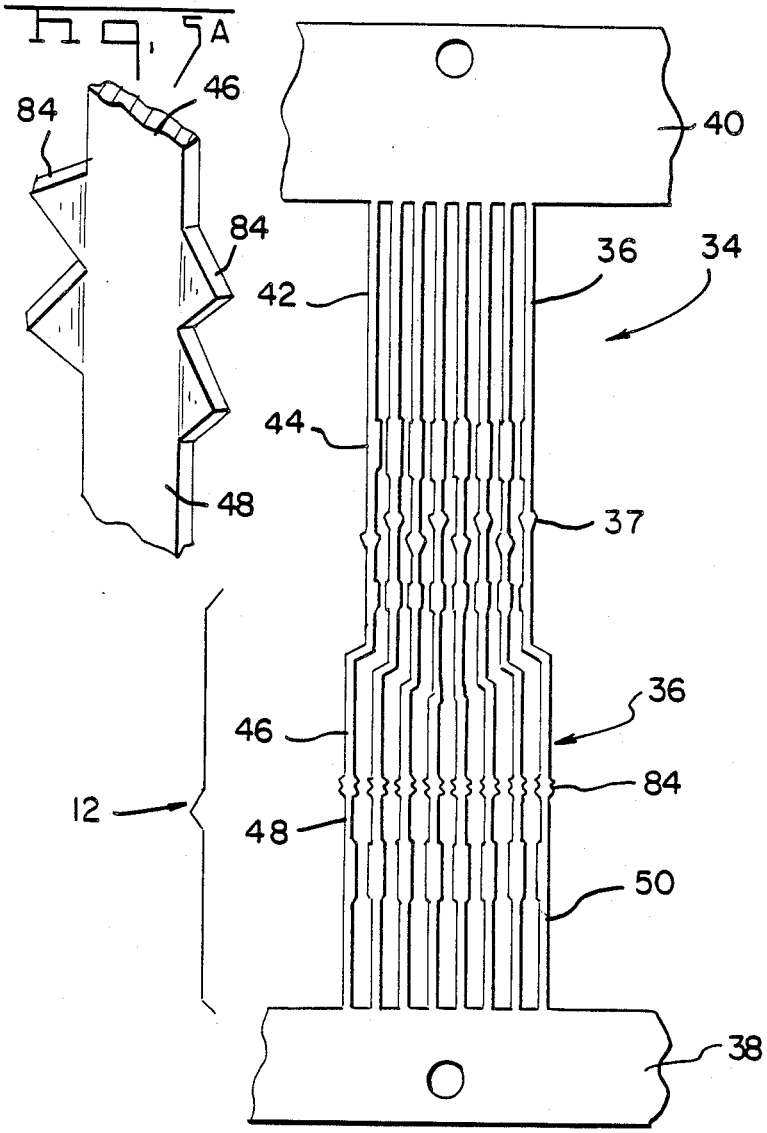
FIG. 5 is a plan view of a lead frame which contains a plurality of connector conductors which are assembled to a connector housing in the manner shown in FIGS. 6 and 7.

The housing contains a plurality of sheet metal conductors 34 which are manufactured by stamping and forming, and are originally configured as a lead frame, as shown in FIG. 5. Each lead frame contains the number of individual sheet metal conductors 34 which are required for an individual housing. The conductors 34 are integral at their ends with spaced apart carrier strips 38, 40 which are sheared from the ends of the conductors when the conductors are assembled to the connector housing as described below. As shown in FIG. 5, each conductor 34 has a spring arm contact portion 42, an intermediate portion 44 which is located on the top wall 30 of the housing, and a lead portion 12. Each of the lead portions 12 comprises an adjacent portion 46, an intermediate portion 48, and an end portion 50. The adjacent portion 46 is adjacent to the side surface 24; the intermediate portion 48 is formed into a spring as will be described below, and the end portion 50 extends away from the side 24 of the housing and has the contact portion 14 on its extreme end. Barbs 37 are provided on the portions 44 of the conductors to anchor the conductors in shallow channels which extend inwardly on the housing top wall to secure them in place. Barbs 84 are included on the intermediate portions 48 to anchor the terminals to the rear side wall 24. The barbs are shown in greater detail in FIG. 5A as including individual teeth which allow easy entry into the channels, and which lock the terminals within the channels once inserted.

Figure 9:
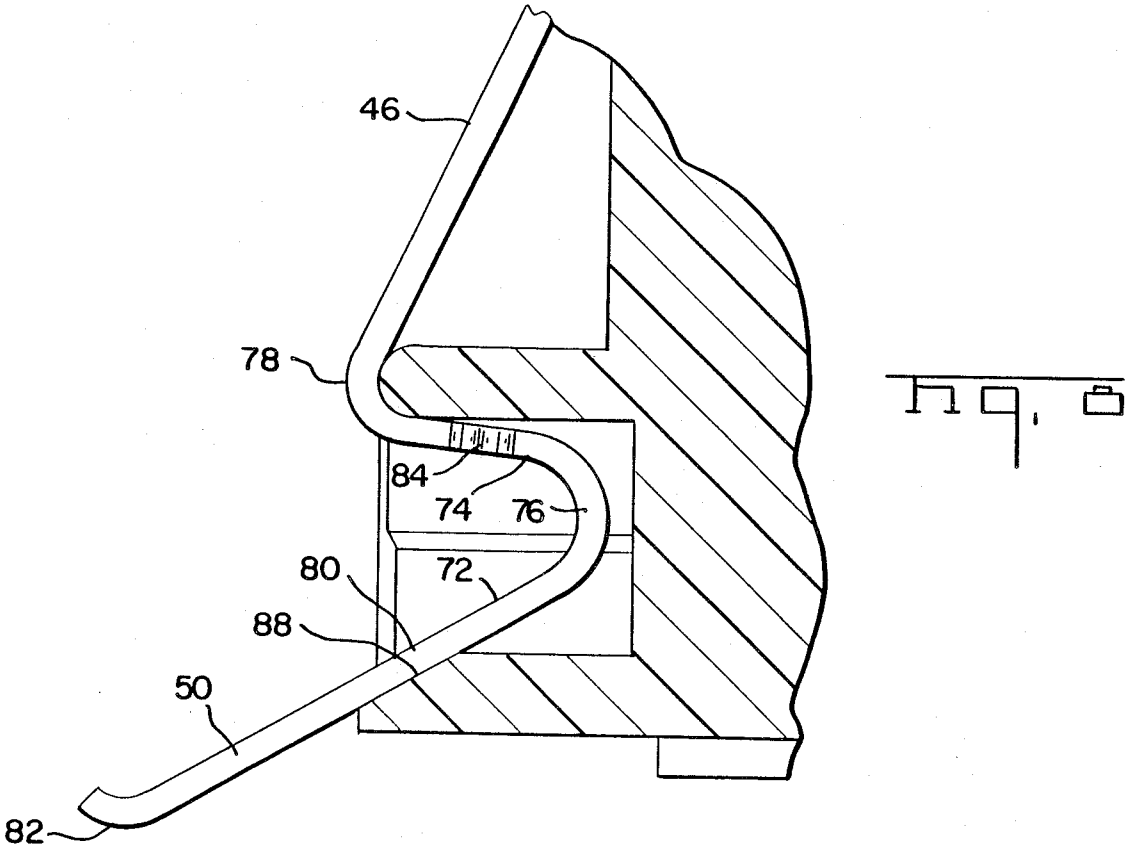
FIG. 9A is an isometric view of the housing partially broken away to show the internal characteristics of the housing.
FIG. 9B is a view similar to that of FIG. 9A showing an alternative embodiment of the housing.
Figure 9A:
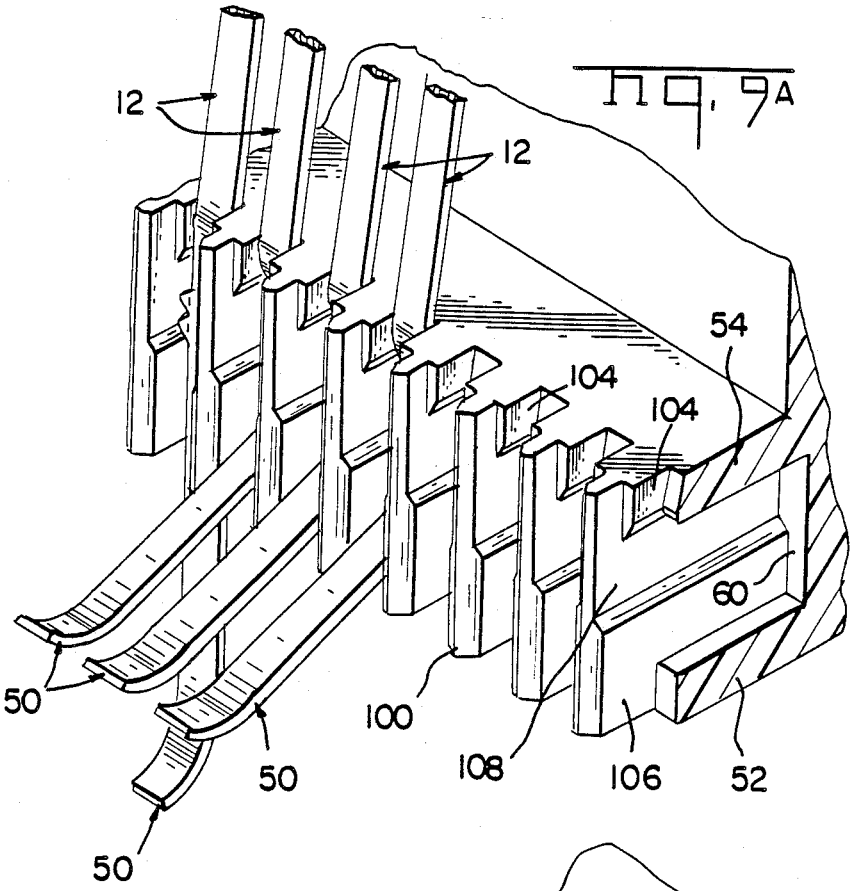

As shown in FIG. 9A, the rear side surface 24 includes a plurality of upstanding walls 100 extending outwardly therefrom which form between them, upright channels for receipt of the terminals. Each of the walls includes raised surfaces 104 and 106, and recessed surfaces 108, which will be described more fully herein. However, it should be noted that the raised surfaces 104 and 106, of two adjacent walls, face each other to form constricted passageways, while the surfaces 108 face each other, but provide a larger spacing therebetween.

In addition to the walls 100, the rear side surface 24 of the housing has first and second spaced apart flanges 52, 54 extending therefrom in a parallel manner relative to the board. Each of the flanges is integral with, and extends between two of the adjacent walls 100. The first flange 52 is adjacent to the mounting surface 22 while the second flange 54 is spaced from the mounting surface. The two spaced apart flanges 52 and 54, in combination with the two walls 100 form individual recesses 60 between the walls 100. As shown in FIG. 3, each of the recesses 60 has opposed first and second recess surfaces 62, 64 which are proximate to, and spaced from, the mounting surface respectively. The first flange 52 has a first lip 66 at its mouth end, while the second flange has a second lip 68 at its mouth end. The first and second lips are at the lower and upper ends, respectively, of the channels which are provided in the first and second flanges.

Figure 6:
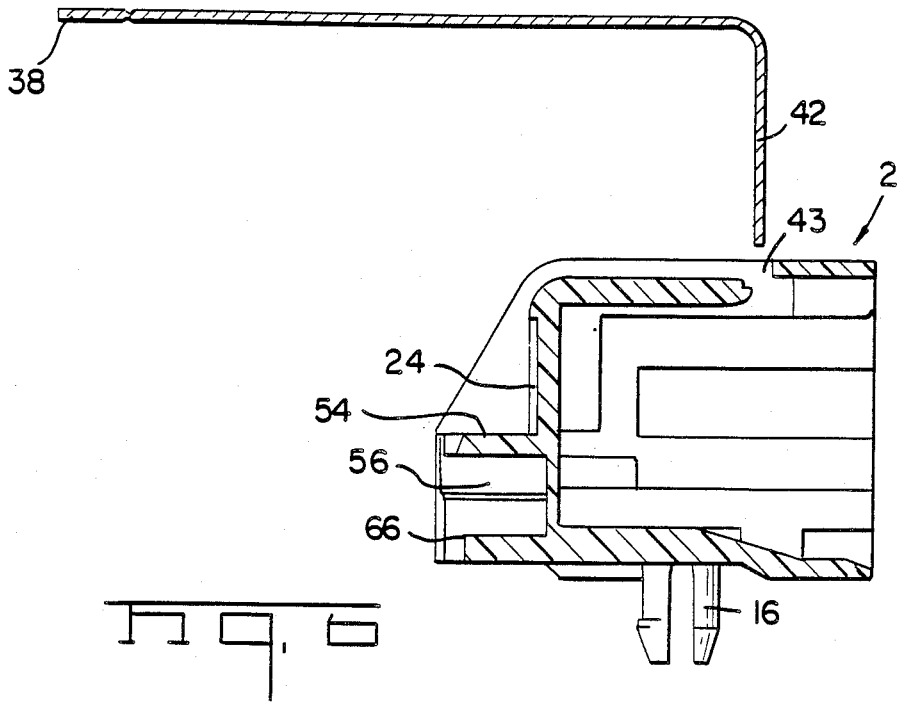
FIGS. 6 and 7 are sectional side views of a connector housing which illustrate the manner of assembling the connector conductors to the connector housing.
Figure 7:
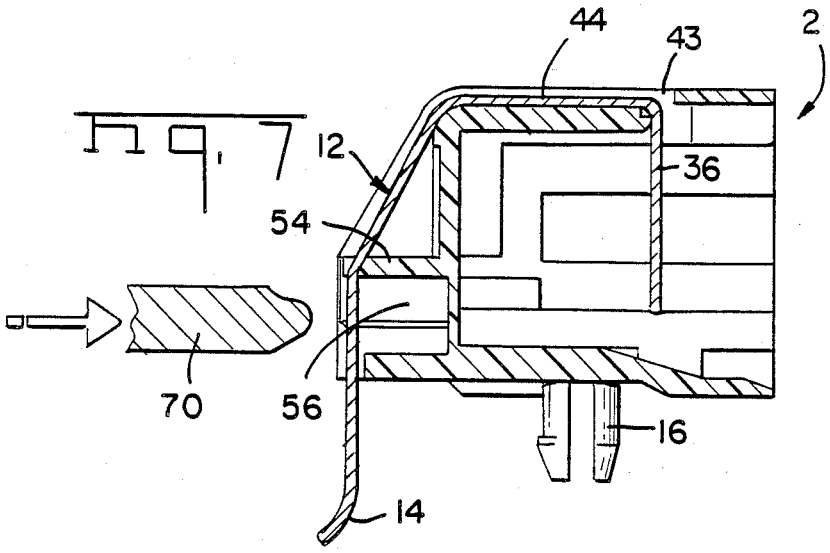

Referring now to FIGS. 5–7, when the connector conductors 34 are assembled to the connector housing, the carrier strip 40 is severed from the lead frame and the spring contact portions 42 are bent normally of the intermediate portions 44. The contact portions 42 are then moved downwardly through spaced apart openings 43 in the top wall 30 of the housing and the intermediate portions 44 can be moved into the shallow channels in the top wall. The lead portions 12 comprising terminal sections 46, 48, and 50 will then extend rearwardly beyond the back wall 24 of the housing. These lead portions are then bent downwardly and are positioned in the channels between adjacent walls 100, and adjacent to first and second lip portions 66, 68 of flange 52, 54, as shown in FIG. 7. Conveniently, when the terminal lead sections are in the position shown in FIG. 7, the barbs 84 will skive into the surfaces 108 (FIG. 9A) of the walls 100, to secure them in place prior to the final forming operation. A forming tool 70 is then moved against the intermediate portions 48 of the leads and serves to tuck these portions into the individual recesses 60. The second flange member 54 acts as a mandrel for the forming of the contact portion 48 thereabout. The portions 48 are bent around the second lip 68 as shown and a generally U-shaped spring is thereby formed in each lead. To the extent that the first flange 52 cooperates with the second flange in the forming operation of the spring, the two flanges can be thought of as dies which cooperate with the tool member 70 for the forming operation.

As shown in FIG. 3, each spring has a first arm 72 which is adjacent to the first recess surface 62, a second arm 74 which is adjacent to the second recess surface 64, and a bight portion 76. The second arm 74 of each spring is connected by a transition section 78 to the associated adjacent lead portion 46. The portion 80 of each lead which extends from the mouth of its associated recess and over the first lip portion 66 serves as an aligning or locating portion in that it maintains the end portions 50 of the leads in coplanar relationship.

After the forming tool is withdrawn, the formed springs will be as shown in FIGS. 1 and 3. The leads are severely bent by the forming tool when the U-shaped spring members are formed and when the forming tool is withdrawn, the individual leads tend to "spring back", that is they tend to partially return to their original configuration. The phenomenon of spring back can be observed if one bends a piece of sheet metal through a 90 degree angle and then releases it. Depending upon the temper of the metal, the bent piece after release will move slightly back towards its original position so that the finished bent section of metal will not have a 90 degree bend. Ordinarily, this phenomenon of spring back is regarded as a problem in metal forming operations and must be taken into consideration when a stamped and formed metal part is designed. In fact, the very reason for providing the retention means 84, is for the spring back of the 46 which lies adjacent to the rear side wall 24, as it tends to return to its original horizontal position.

In the practice of the instant invention, however, the spring back phenomenon works to the advantage of the finished product in that the end portion 50 of each lead 12 is resiliently biased against the first lip portion 66, the locating portion, of the associated recess 60. The housing itself is of molded plastic material and is, for that reason, precisely dimensioned. It follows that since the aligning or locating portions of the leads are biased against the first lip portions, and the first lip portions are precisely aligned with each other, the end portions 50 of the lead and the contact portions thereof will be held in precise coplanar relationship.

It will be apparent from FIG. 1 that the contact portions 14 are below the mounting surface 22 of the housing. By virtue of this feature, the end portions of the leads will be flexed upwardly, as viewed in FIG. 1, when the connector is mounted on the circuit board surface 4. The contact portions will, as a result, be resiliently biased against the terminal pads; and sufficient and uniform electrical contact between the contact portions 14 and the terminal pads 10, will be assured.

Furthermore, the terminals are fixedly arranged within the channels due to the side edges of the terminals in an engaging manner with the surfaces 104 and 106. The terminals are fixed at two points along their length, that is, between the two surfaces 104, and between the two surfaces 106. This assures that the long beam length of the terminals, due to the intermediate spring, is sufficiently supported and aligned, relative to the lateral dimension. Furthermore, the beam portion 80 is at an acute angle relative to a height of the surface 106, assuring that a long span of terminal is aligned and straightened by the constriction formed by the two facing surfaces 106 (FIG. 9A). All of the above features cooperate to assure that the contact portions 14 which extend rearwardly, and which are spaced from, the rear side all 24 of the housing are precisely aligned and spaced laterally for precise location with the terminal pads 10 on the printed circuit board.

As discussed above, a retention barb 84 is provided as shown on the second arm 74 of each spring member, and during formation of the spring member, the leg portion 74 swings on arcuate path around the lip 68 of the second flange portion thereby causing the barb 84 to skive an arcuate path 86 toward the second side surface 64 of the flange 54. Said differently, when the forming tool is projected into the channels to force the individual terminals into individual recesses 60, the barbs 84 are swung through an arcuate path 86 which skives the recessed suraces 108 of the walls 100. As mentioned above, when the forming tool seats the terminals within the recesses 60, each formed terminal includes a U-shaped spring, formed by the terminal portions 72, 74 and 76.

It should be appreciated that metal spring back works to an advantage once again. As the spring is positioned between the two flanges 52 and 54, and as the leg portion 72 of the spring is resiliently biased against the lip 66 of the flange 52, an upward reaction force is placed upon the leg 72, which carries through to leg portion 74. This results in the retention barb being forced upwardly further towards the second recess surface 64. Advantageously, this spring force always forces the barb deeper into unskived material, as the barb is force further in its arcuate path, rather than attempting to retreat through its original footprint. The same is true when the connector is placed upon the board, as the reaction force against the contact portion 14 will be upward, and will attempt to further seat the barb 84 within the plastic.

As mentioned above, the second lip portion 68 is used as a mandrel for the forming of the arcuate path of the terminal portion 74. The upper corner 57 of the housing is used as a mandrel for the forming of the terminal portion 46, which, as it should be noted, is of a larger radius than the forming radius of terminal portion 74. To unseat the terminal from the housing at the rear side, would require that the terminal portion 46 return through its original swing path. This would require the barbs 84 to skive through the surfaces 108 of the walls 100. What is important to note, is that the barbs would have to skive through plastic material which has not yet been cut.

As can be appreciated to one knowledgeable in the area of retention features such as barbs skiving into plastic, the removal of the terminal from the housing rear side wall 24 would not just require that the barbs skive through uncut plastic. Rather, as the barbs 84 skive through the plastic material on its original arc, the plastic material flows, or parts, to form somewhat of a channel. Thus, if the barbs were to be unseated from the rear side wall 24 of the housing the barb 84 would also have to cut through, or ride over, the plastic material which flowed to form the skived channel. Furthermore, since the removal of the terminal would require the terminal portion to swing through its original path or arc, the barbs would have to swing through the raised surface 104.

Figure 9B:
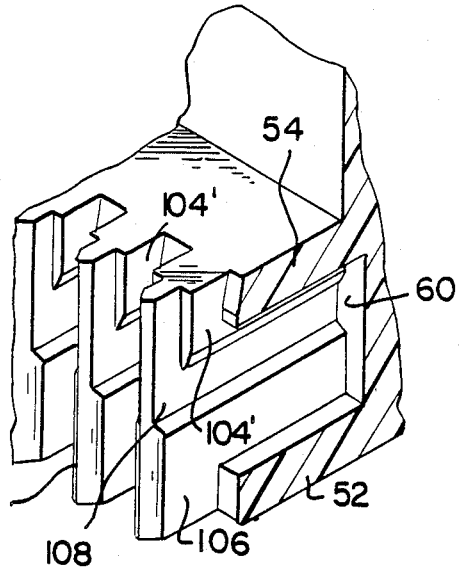

FIG. 9B shows an alternate housing where the walls have surfaces 104' which extend lower into the housing such that when the barbs are swung in, the barbs skive into the raised surface 104'.

FIG. 8 shows an alternative embodiment in which the first lip, against which the first arm is biased, comprises an inclined surface 88 rather than a sharp edge. Under some circumstances, this alternative may be preferable.

It shoud be appreciated that the instant invention is not limited for use with surface mount applications. For example, the lead section could be for use with through hole type terminals, the lead section includes sheared portions flanking the lead section which extends downwardly towards the board. The sheared sections would include barbs on their outer edges. When the terminal is to be retained to the housing the sheared sections, not the entire lead section, is forced into the channels through an arcuate path similar to th eabove described. The lead section is maintained in a substantially vertical section for through hole mounting.

I claim:

1. An electrical connector for printed circuit board mounting, comprising:

an insulative housing comprising a mating face and a mounting face, and a plurality of channels integrally formed with the housing and disposed proximate to the mounting face; and a plurality of electrical terminals including a mating portion and a lead means, the lead means comprising at least one barb portion which is disposed within the channel in an interfering fit with suraces of the channels, the barb portion being disposed within the channel in a position vertically above a skived path formed by the entry of the barb.

2. The electrical connector of claim 1 wherein the housing means comprises a mandrel formed by a flange which extends from a rear side wall and the terminals are bent over the mandrel to form the lead means which extend adjacent to the rear side wall.

3. The electrical connector of claim 2 wherein the portion of the lead means having the barb is formed upwardly beneath the mandrel.

4. The electrical connector of claim 3 wherein the housing includes a further flange extending from the rear sidewall thereof in a spaced apart relation to the mandrel, the further flange and the mandrel forming a recess.

5. The electrical connector of claim 4 wherein the lead means comprises a spring portion disposed in the recess means.

6. The electrical connector of claim 5 wherein the spring portion comprises first and second leg portions interconnected by a bight portion, at least one of said leg portions being resiliently biased against the further flange, thereby spring loading the barb portion further upwards.

7. An electrical connector of the type comprising an insulative housing having a mating face for the receipt of a complementary connector, and a mounting face for mounting the connector to a printed circuit board, the connector further comprising a plurality of terminals having contact portions for mating engagement with the complementary connector and lead portions adjacent to the mounting face for interconnection to electrical traces on the printed circuit board, the housing having means to retain the lead portions of the terminals to the housing in precise alignment with the circuit traces on the printed circuit board; the electrical connector being characterized in that:

the lead portions of the terminals are arranged for engagement with circuit pads on the same surface as the surface to which the connector is mounted; and in that the retaining means is formed by the terminals including integral spring portions, and the terminals further including retention portions which cooperate with the insulative housing, the spring portions biasing the retention portions into further retentive condition.

8. The connector of claim 7 characterized in that the insulative housing includes first flange which extends from the housing, the spring portions being disposed adjacent to and in resilient contact with, the flange.

9. The connector of claim 8 characterized in that the insulative housing includes a second flange which is spaced from the first said flange.

10. The connector of claim 9 characterized in that the first and second flanges extend from a rear side wall of the housing and are substantially parallel with the mounting surface of the housing surface.

11. The connector of claim 10 characterized in that the spring portion is substantially U-shaped having a first and second leg being interconnected by a bight portion the first leg adjacent to the first flange and the second leg being disposed adjacent to the second flange.

12. The connector of claim 11 characterized in that the retention portions comprise barbs which are located in the second leg; and in that the first leg is in contact with the first flange, which places the spring portions in spring loaded condition thereby forcing the barbs further into the housing.

13. In a connector having an insulating housing where a mating face is provided for receipt of a complementary connector, and a mounting face is provided for receipt on a printed circuit board, and at least one electrical terminal is included having a contact portion proximate the mating face and lead means adjacent to the mounting face for interconnection to an electrical conductor of the printed circuit board, a method of retaining the lead means to the housing comprises the steps of:

providing at least one channel on one face of the connector;

providing at least one retention barb on a portion of the lead means;

bending the lead means over a first mandrel to dispose the lead means to a position adjacent to the channel; and moving the portion of the lead means carrying the barb into the channel where the barbs interferingly retain the lead means to the housing.

* * * * *